United States Patent [19]

Modena et al.

[11] 4,187,397

[45] Feb. 5, 1980

[54] DEVICE FOR AND METHOD OF GENERATING AN ARTIFICIAL SPEECH SIGNAL

[75] Inventors: Giulio Modena, Caselle-Torino; Stefano Sandri, Turin; Carlo Scagliola, Caselle-Torino, all of Italy

[73] Assignee: CSELT - Centro Studi e Laboratori Telecomunicazioni S.p.A., Turin, Italy

[21] Appl. No.: 916,356

[22] Filed: Jun. 16, 1978

[30] Foreign Application Priority Data

Jun. 20, 1977 [IT] Italy ..... 68420 A/77

[51] Int. Cl.[2] ..... G10L 1/10

[52] U.S. Cl. ..... 179/1 SG

[58] Field of Search ..... 179/1 SA, 1 SF, 1 SG, 179/1 SM; 307/105; 333/28 R, 28 T

[56] References Cited

U.S. PATENT DOCUMENTS

| | | | |
|---|---|---|---|
| 3,549,807 | 12/1970 | Rabiner | 179/1 SA |
| 3,909,533 | 9/1975 | Williman | 179/1 SA |

*Primary Examiner*—Malcolm A. Morrison
*Assistant Examiner*—E. S. Kemeny
*Attorney, Agent, or Firm*—Karl F. Ross

[57] ABSTRACT

To produce a signal simulating the characteristics of the average human voice, a basic periodic waveform with generally sinusoidal sections separated by level sections is passed through a first filter for substantially equalizing its frequency components and is then shaped in a second filter whose transfer function approximates that of the vocal tract in a frequency band of 0 to 4 kHz. The basic waveform fed to the first filter may be modulated in amplitude and/or recurrence period by a pseudorandom signal from an ancillary generator.

8 Claims, 4 Drawing Figures

DEVICE FOR AND METHOD OF GENERATING AN ARTIFICIAL SPEECH SIGNAL

FIELD OF THE INVENTION

Our present invention relates to speech-transmission systems and more particularly to telephone transmission systems, and it concerns a method of and a device for generating a speech signal to be used for the objective evaluation of the performance of the equipment employed in such systems.

BACKGROUND OF THE INVENTION

A conventional method of evaluating the performance of the equipment employed for speech-signal transmission consists, as far as possible, in objective measurements, carried out without human speakers or listeners.

The results of subjective measurements, performed with human speakers and/or listeners depend too much on the type of voice, on the speaker and/or listener and even on the text utilized for the test; results sufficiently reliable might be obtained only by utilizing a great number of speakers and/or listeners and texts of a certain length, which would make the tests long and hence costly.

In general, the procedure for performing objective measurements consists in sending into the apparatus to be tested a suitable input signal, and in calculating, at the output of the system, the signal-to-noise ratio for the received or reconstructed signal, evaluated as the ratio between input-signal power and error-signal power (the error signal may be defined as the difference between input and output signals). The higher the ratio, the better the evaluated system quality.

The input signals most frequently used are sinusoidal signals of various frequencies, in the range of 800 to 1000 Hz, or white gaussian or laplacian noise, because these signals may be processed easily and so they are particularly useful for tests carried out through simulation techniques.

The use of signals of this kind whose spectral and amplitude characteristics are not those of vocal signals, however, may entail considerable difference between objective and subjective performance evaluations, i.e. measurements obtained with a real listener receiving real speech signals.

The difference between objective and subjective measurements is greater in digital transmission systems; recent studies demonstrated that in digital transmission systems the simple signal-to-noise ratio is no longer a parameter sufficiently meaningful, but it is necessary to distinguish at least between quantization-noise effects and the effects of the distortion due to amplitude overload (or slope in the case of differential systems), also taking into account the relative magnitudes of these two factors. However, owing to their statistical characteristics, neither white noise nor a sinusoidal signal allows to distinguish exactly between the two above-cited noise components, as is easy to demonstrate and has been experimentally verified.

On the other hand it is not feasible to employ for quality tests an artificial signal obtained by voice synthesis, since such artificial signal would present all the inconveniences inherent in the use of a real signal, i.e. a dependency not only on the synthesis method, but also on the speaker, the text, the language; furthermore, signal generation by voice synthesis is a very complex and delicate process.

OBJECT OF THE INVENTION

Thus, our invention aims at providing a method of and a device for producing an artificial signal having the statistical characteristics of the average human voice, thereby enabling satisfactory correlation between subjective and objective quality measurements.

SUMMARY OF THE INVENTION

We attain this object, in accordance with our present invention, by first generating a periodic waveform whose frequency components substantially correspond to those produced by glottal excitation of the vocal tract, within a predetermined frequency range preferably extending between substantially 0 and 4 kHz. This periodic waveform is then converted, in a first filter, into an intermediate signal in which the amplitudes of its frequency components are substantially equalized; the intermediate signal is thereupon transformed, in a second filter, into an output signal in which the aforementioned amplitudes correspond substantially to those of the voice spectrum in the frequency range referred to.

In accordance with another feature of our invention, we may modulate the amplitude and the recurrence period—or at least one of these parameters—of the periodic waveform by a pseudorandom signal from an ancillary generator before feeding that waveform to the two cascaded filters designed to produce the desired output signal.

BRIEF DESCRIPTION OF THE DRAWING

The above and other features of our invention will now be described in detail with reference to the accompanying drawing in which.

SPECIFIC DESCRIPTION

Some theoretical principles must be stated before describing the system according to our present invention.

As is known, speech emission may be affected by various parameters; among them there are: the type of sound produced by the sound-excitation source, the variability in time and space of the configurations of the vocal tract (that is of the nonuniform acoustic tube between glottal aperture and lips), the nonuniform duration of excitations, and the possibility that the nasal cavities are more or less involved in sound transmission.

A device for generating a voice-type signal may be schematized by a sound source, simulating vocal cords, and by a transmission system simulating the vocal tract and acting as a filter that imposes its resonance characteristics upon the acoustic waves generated by the source.

By assuming that mutual interactions between sound source and transmission systems may be neglected (which can be done without too much loss of general applicability) it is possible to realize the source in such a way that it generates a white-spectrum signal, and the filter so as to concentrate therein the spectral contributions due to glottal waveform, to radiation and to transmission.

Figure 1:
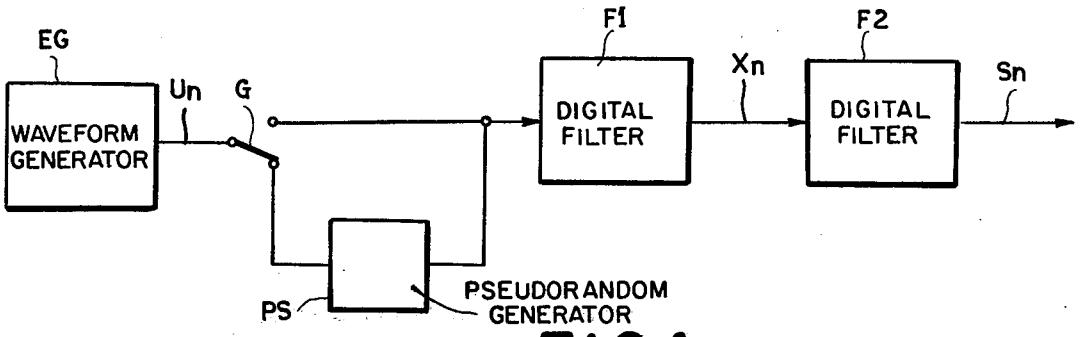
FIG. 1 is a block diagram of a device according to our invention.

The device in accordance with the invention, which satisfies these requirements, is represented in FIG. 1.

Figure 2:
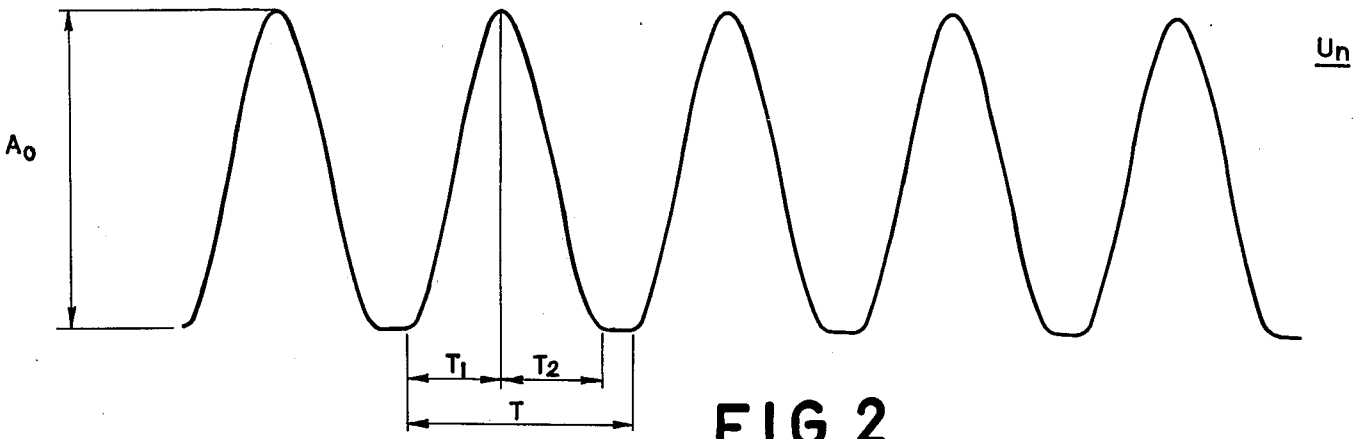
FIG. 2 represents a signal simulating glottal excitation.

Reference EG denotes a periodic-waveform generator whose output signal $U_n$ simulates the real glottal excitation. As shown in FIG. 2, such a waveform, having amplitude $A_O$ and period T, is formed of three distinct parts: a rising part of duration $T_1$, a descending part of duration $T_2$, and a level part of duration $T - T_1 - T_2$. These three parts should be completely independent from one another, so that both the shape and the duration of signal $U_n$ may be easily changed if required. It will be noted that the ascending and descending flanks of each cycle are of generally sinusoidal configuration.

Reference F1 denotes a linear-phase digital filter, whose transfer function is basically the inverse of the amplitude spectrum of periodic signal $U_n$; in this way an intermediate signal $X_n$ with flat amplitude spectrum is obtained at the output of filter F1, a second digital filter F2 approximates the average transfer function of the vocal tract; at its output the desired artificial signal $S_n$ is obtained. The way in which the transfer function may be determined is well known to persons skilled in the art, and will not be described in detail; for instance, the transfer function may be determined by linear-prediction techniques. If, for example, vocalized and nonnasal sounds are to be simulated, filter F2 may consist of a constant-parameter filter with a characteristic having only poles and no zeros. This limitation does not unduly diminish the general applicability of the system according to our invention, as these sounds account for a large percentage of the constituents of speech; on the other hand, it allows to have a signal with fixed spectral characteristics. This simplification is also justified by the fact that many voice-processing systems aiming at reduction of redundancies operate with adaptive quantization of the input waveforms and thus, as is known, are not so sensitive to spectral variations.

Considering, as previously stated, that the signal to be generated must be employed for testing equipment inserted in a telephone system, the transfer function of filter F2 is preferably chosen to reproduce the average spectrum of voice amplitude in frequency bandwidths from 0 to 4 kHz.

Figure 3:
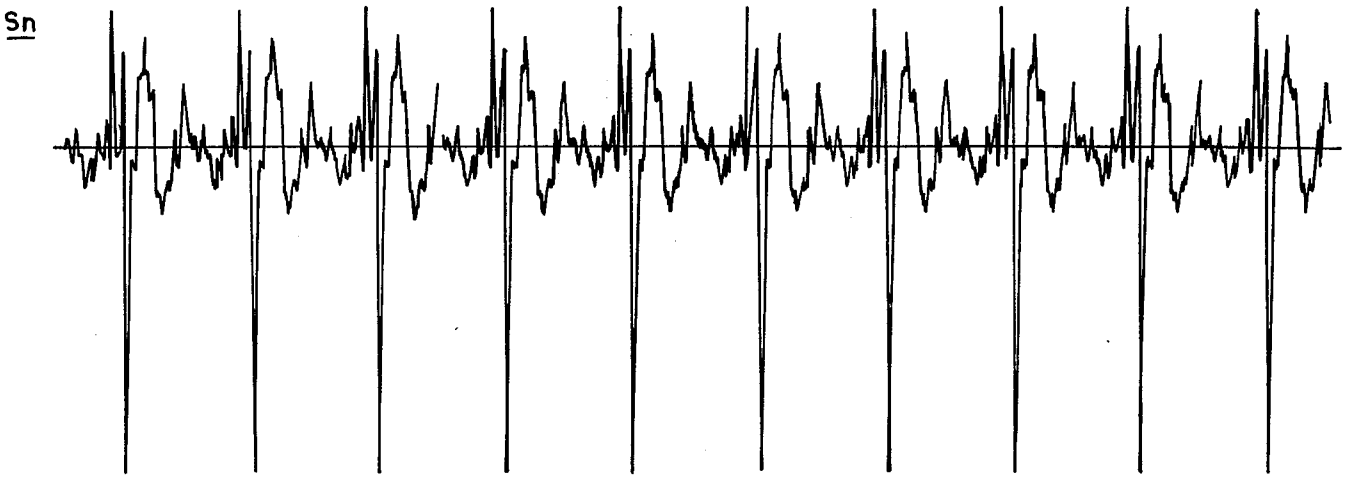
FIGS. 3 and 4 are two possible examples of an artificial signal which may be obtained from the waveform of FIG. 2.

The described device generates a periodic signal $S_n$ as shown in FIG. 3. Owing to its periodic structure, the parameters of this signal are invariant; where this rigidity is not wanted, a variability may be introduced for better approximation of voice characteristics.

Such a variability may be obtained by a pseudorandom-signal generator PS (FIG. 1) insertable, through a switch G, between primary signal generator EG and F1 for introducing a pseudorandom variation in the amplitude and/or in the period of signal $U_n$.

Advantageously, generator PS may be able to change the amplitude of variable signal $S_n$ during a certain period on the basis of the amplitude of this signal in the preceding period and of the amplitude of periodic signal $U_n$. Thus, for instant, the law of variation may be of the form $$A_n = C \cdot A_{n-1} + (1 - C) \cdot A_0 (1 + p \cdot w_n)$$

where:

$A_n$ is the amplitude of the desired signal $S_n$ in the nth period;

$A_{n-1}$ is the amplitude of signal $S_n$ in the (n−1)th period;

$A_0$ is the amplitude of periodic signal $U_n$

C is a coefficient, comprised between 0 and 1, determining the amplitude covariance, i.e. is the possible amplitude variation between successive periods of the signal;

P is the greatest proportional variation, with respect to value $A_0$; the value of P is so chosen that the variations in spectral characteristic with respect to the basic $U_n$ are very limited, so as to allow filter F1 to carry out its aforedescribed task of amplitude equalization;

$w_n$ is an uncorrelated random variable (i.e. one whose value at a certain instant is not correlated with its value of the preceding instant); it may take values uniformly distributed in the range −1 to +1.

The law of periodic variation may be, for instance, of the form $$T_n = T(1 + y_n \frac{\Delta T}{T}),$$

where:

$T_n$ is the desired $n^{th}$ period of the waveform;

T is the period of signal $U_n$;

ΔT is the greatest permissible variation of time;

$y_n$ is an uncorrelated random variable analogous to $w_n$.

To facilitate the realization of pseudo random-signal generator PS, the variable $y_n$ may conform, instant by instant, with $w_n$.

Figure 4:
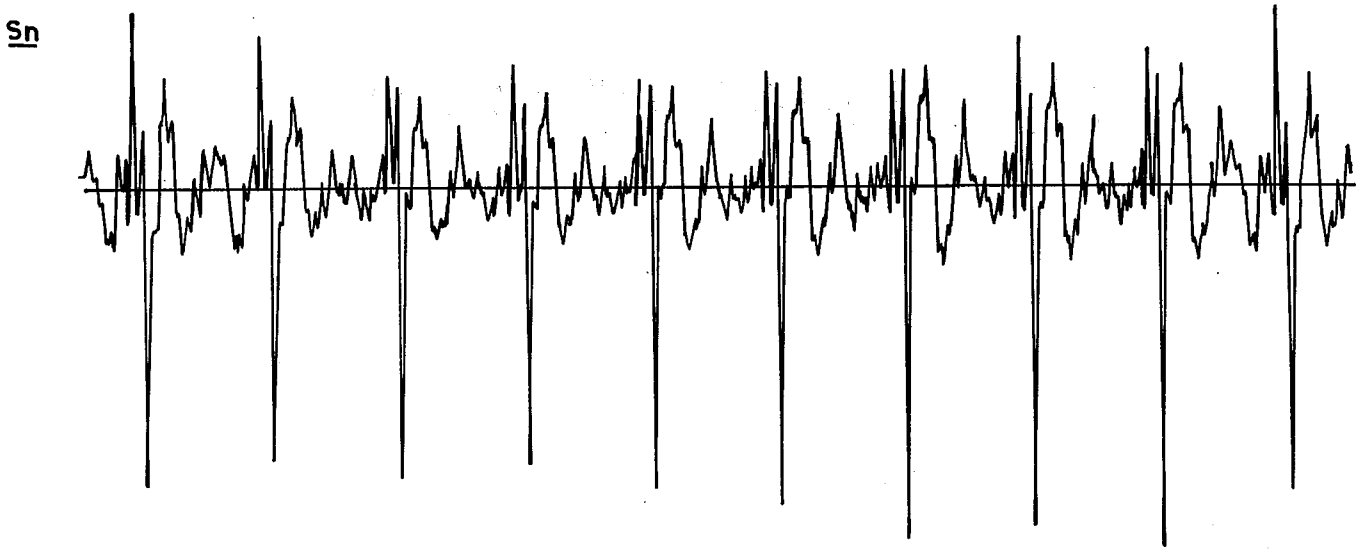

The artificial signal obtained by the device according to the invention, with pseudorandom variation of amplitude and/or period, is represented in FIG. 4.

The mode of operation of the described device may be easily deduced from the above-discussed operation of its individual units. Thus, the periodic signal $U_n$ (FIG. 1) generated in component EG and possibly undergoing a pseudorandom variation of amplitude and period in unit PS is filtered first in unit F1, whose transfer function is basically the inverse of the amplitude spectrum of signal $U_n$ to yield a signal with flat amplitude spectrum, and is then filtered in unit F2 so as to assume the mean spectral characteristics of telephone speech. The signal obtained at the output of filter F2, two examples of which are represented in FIGS. 3 and 4, is then sent as an input signal to the apparatus to be tested, not represented in the drawing.

What we claim is:

1. A method of producing a simulated voice signal for measuring the performance of voice-transmitting equipment, comprising the steps of:

generating a periodic waveform whose frequency components substantially correspond to those produced, within a predetermined frequency range, by glottal excitation of the vocal tract;

converting said periodic waveform into an intermediate signal in which the amplitudes of said frequency components are substantially equalized; and transforming said intermediate signal into an output signal in which the amplitudes of said frequency components correspond substantially to those of the voice spectrum in said predetermined frequency range.

2. A method as defined in claim 1 wherein said predetermined frequency range is between substantially 0 and 4 kHz.

3. A method as defined in claim 1 wherein said periodic waveform consists of a generally sinusoidal section and a substantially level section in each cycle.

4. A method as defined in claim 1, 2 or 3, comprising the further step of subjecting at least one of two parameters of said periodice waveform, respectively representing the amplitude and the recurrence period thereof, to pseudorandom variations before converting same into said intermediate signal.

5. A device for producing a simulated voice signal for measuring the performance of voice-transmitting equipment, comprising:

signal-generating means emitting a periodic waveform whose frequency components substantially correspond to those produced, within a predetermined frequency range, by glottal excitation of the vocal tract;

first filter means connected to receive said periodic waveform for converting same into an intermediate signal in which the amplitudes of said frequency components are substantially equalized; and second filter means connected to receive said intermediate signal for transforming same into an output signal in which the amplitudes of said frequency components correspond substantially to those of the voice spectrum in said predetermined frequency range.

6. A device as defined in claim 5 wherein said first filter means has a transfer function which is substantially the inverse of the amplitude spectrum of said periodic waveform, said second filter means having a transfer function approximating that of the average vocal tract.

7. A device as defined in claim 6 wherein said second filter means has constant parameters and poles but no zeros in a frequency range between substantially 0 and 4 kHz.

8. A device as defined in claim 5, 6 or 7, further comprising an ancillary generator of pseudorandom signals inserted between said signal-generating means and said first filter means for subjecting at least one of two parameters of said periodic waveform, respectively representing the amplitude and the recurrence period thereof, to pseudorandom variations.

* * * * *